US010667584B2

(12) United States Patent
Liao et al.

(10) Patent No.: US 10,667,584 B2
(45) Date of Patent: Jun. 2, 2020

(54) WEARABLE DEVICE AND MAIN BODY OF WEARABLE DEVICE

(71) Applicant: Huawei Technologies Co., Ltd., Shenzhen (CN)

(72) Inventors: YiHsiang Liao, Shenzhen (CN); Hongwei Du, Xi'an (CN); Yanlei Ma, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 16/337,848

(22) PCT Filed: Sep. 28, 2016

(86) PCT No.: PCT/CN2016/100675
§ 371 (c)(1),
(2) Date: Mar. 28, 2019

(87) PCT Pub. No.: WO2018/058388
PCT Pub. Date: Apr. 5, 2018

(65) Prior Publication Data

US 2019/0350320 A1 Nov. 21, 2019

(51) Int. Cl.
*A44C 5/14* (2006.01)
*G04B 37/14* (2006.01)

(52) U.S. Cl.
CPC ..... *A44C 5/147* (2013.01); *G04B 37/1493* (2013.01)

(58) Field of Classification Search
CPC ..... A44C 5/14; A44C 5/147; G04B 37/1493; G04B 37/1486; Y10T 24/4718; Y10T 24/4782
See application file for complete search history.

(56) References Cited

U.S. PATENT DOCUMENTS 4,234,115 A 11/1980 Williams
4,974,218 A 11/1990 Loth et al.
(Continued)

FOREIGN PATENT DOCUMENTS

CH 662697 A 10/1987
CN 1043008 A 6/1990
(Continued)

OTHER PUBLICATIONS

Machine Translation and Abstract of Swiss Publication No. CH662697, Oct. 30, 1987, 6 pages.
(Continued)

*Primary Examiner* — Corey N Skurdal
(74) *Attorney, Agent, or Firm* — Conley Rose, P.C.

(57) ABSTRACT

A wearable device includes a main body and a wristband. The main body includes a main case and a bottom cover, a spring bar is disposed on the wristband, a connection member configured to couple to the spring bar is disposed on the main case and has two connection lugs, an accommodating hole is provided on each connection lug, one end of the accommodating hole has an opening, the other end of the accommodating hole is provided with a limiting portion, the limiting portion is provided with a through hole, a locating groove is provided on the connection lug, a button is disposed on the connection lug, the button is slidably disposed in the accommodating hole, a limiting groove is provided on the button, a limiting portion is disposed on the bottom cover, and the limiting portion is located in the locating groove and extends into the limiting groove.

20 Claims, 6 Drawing Sheets

(56) References Cited

U.S. PATENT DOCUMENTS

| | | | | |
|---|---|---|---|---|
| 5,951,193 | A * | 9/1999 | Yamamoto | A44C 5/105 24/265 B |
| 6,401,307 | B1 * | 6/2002 | Wild | A44C 5/246 24/265 WS |
| 7,249,398 | B2 | 7/2007 | Roy | |
| 7,568,263 | B2 | 8/2009 | Kim et al. | |
| 2002/0104192 | A1 * | 8/2002 | Iguchi | A44C 5/12 16/386 |
| 2012/0168471 | A1 | 7/2012 | Wilson | |
| 2013/0286796 | A1 | 10/2013 | Chatelain | |
| 2014/0096345 | A1 * | 4/2014 | Tschumi | G04B 37/1486 24/265 B |
| 2014/0366339 | A1 | 12/2014 | Haering et al. | |
| 2016/0070234 | A1 | 3/2016 | Lee et al. | |

FOREIGN PATENT DOCUMENTS

| | | | |
|---|---|---|---|
| CN | 1726437 | A | 1/2006 |
| CN | 103376734 | A | 10/2013 |
| CN | 104223615 | A | 12/2014 |
| CN | 104698810 | A | 6/2015 |
| CN | 205358496 | U | 7/2016 |
| EP | 0682300 | A1 | 11/1995 |
| EP | 1577717 | B1 | 2/2016 |
| FR | 682477 | A | 5/1930 |
| GB | 351922 | A | 7/1931 |
| JP | 2000329871 | | 11/2000 |

OTHER PUBLICATIONS

Machine Translation and Abstract of Chinese Publication No. CN104698810, Jun. 10, 2015, 9 pages.
Machine Translation and Abstract of Chinese Publication No. CN205358496, Jul. 6, 2016, 10 pages.
Machine Translation and Abstract of Japanese Publication No. JP2000329871, Nov. 30, 2000, 13 pages.
Foreign Communication From a Counterpart Application, European Application No. 16917142.8, Extended European Search Report dated Aug. 29, 2019, 7 pages.
Machine Translation and Abstract of Swiss Publication No. CH662697, dated Oct. 30, 1987, 6 pages.
Machine Translation and Abstract of Chinese Publication No. CN104698810, dated Jun. 10, 2015, 9 pages.
Machine Translation and Abstract of Chinese Publication No. CN205358496, dated Jul. 6, 2016, 10 pages.
Machine Translation and Abstract of Japanese Publication No. JP2000329871, dated Nov. 30, 2000, 13 pages.
Foreign Communication From a Counterpart Application, Chinese Application No. 201680084017.7, Chinese Office Action dated Apr. 22, 2019, 5 pages.
Foreign Communication From a Counterpart Application, PCT Application No. PCT/CN2016/100675, English Translation of International Search Report dated Mar. 28, 2017, 4 pages.
Foreign Communication From a Counterpart Application, PCT Application No. PCT/CN2016/100675, English Translation of Written Opinion dated Mar. 28, 2017, 5 pages.

* cited by examiner

WEARABLE DEVICE AND MAIN BODY OF WEARABLE DEVICE

CROSS-REFERENCE TO RELATED APPLICATIONS

This application is a U.S. National Stage of International Patent Application No. PCT/CN2016/100675 filed on Sep. 28, 2016, which is hereby incorporated by reference in its entirety.

TECHNICAL FIELD

The present invention relates to the field of wearable devices, and in particular, to a wearable device and a main body of a wearable device.

BACKGROUND

At present, wearable devices such as smartwatches and smart wristbands are popular. A main body of a wearable device is a main functional part. A strap of the wearable device may be selected based on different requirements of a user. Therefore, usually, the strap is detachably connected to the main body, making it easy to change the strap.

In the prior art, the most commonly seen manner of changing a strap is to detach the strap by means of stretching and contraction of telescopic heads at two ends of a spring bar, to detach the strap for substitution. There are mainly two manners for removing the spring bar: using a tool or by means of a toggle switch attached to the spring bar structure. In the method using a tool, one end of a spring is pressed inward first, and the entire strap is removed after being tilted. A switch on the spring bar structure refers to a spring-loaded toggle switch attached to each end or one end of the spring bar, and can be unlocked when being directly pressed inward by hand. For this manner, a special tool such as a pointed-head tool needs to be inserted into one end of a spring bar, to press a spring structure inward so as to remove the strap, and then a spring bar at the other end of the strap is also pulled out obliquely. In this way, the entire strap can be removed. For this manner, the strap cannot be removed without a tool. In addition, if a width tolerance of the strap is an upper tolerance, the strap is in a close fit with a watch body, making it difficult to insert a tool. Consequently, it is difficult to remove the strap. In addition to the manner of removing the strap by releasing a switch on the spring bar by using a tool, the spring bar may be provided with a driving structure for controlling a toggle slide switch. In this way, a user can remove the strap by hand without using a tool. For this manner, if a part of the strap has any function, a position of the toggle switch of the spring bar may occupy space of a mainboard or space of a connector or a connection wire, and each type of strap needs to be provided with a spring bar having a toggle switch, leading to a complex structure and inconvenience in processing and manufacturing.

A technical problem to be resolved by the present invention is to provide a wearable device and a main body of a wearable device, so that a wristband can be conveniently connected to or detached from the main body, providing a simple structure and convenient assembly.

To resolve the foregoing technical problem, according to an aspect, an embodiment of the present invention provides a main body of a wearable device, where the main body includes a main case and a bottom cover that are fixedly connected to each other; a connection member configured to connect to a spring bar is disposed on the main case, the connection member has two connection lugs, an accommodating hole is provided on each connection lug, one end of the accommodating hole has an opening, the other end of the accommodating hole is provided with a limiting portion, and the limiting portion is closer to the other connection lug than the opening of the accommodating hole; the limiting portion is provided with a through hole in communication with the accommodating hole; a locating groove is provided on a surface of the connection lug facing the bottom cover, and the locating groove is in communication with the accommodating hole;

a button is disposed on each connection lug, the button is slidably disposed in the accommodating hole, and a limiting groove is provided at a position that is on the button and that is corresponding to the locating groove; and a limiting portion is disposed on the bottom cover, the limiting portion is located in the locating groove and extends into the limiting groove, and the limiting portion is capable of preventing the button from moving out of the opening of the accommodating hole.

In a first possible implementation, an elastic member is disposed in the accommodating hole, the elastic member is connected to the button, and the elastic member is capable of providing, to the button, an elastic force toward the opening of the accommodating hole. By means of the elastic member, the button can automatically return to a state before being pressed. Therefore, it is convenient to use.

With reference to the first possible implementation, in a second possible implementation, the elastic member is a compression spring, and two ends of the compression spring respectively press against the button and the limiting portion. When the button moves toward the connection portion, the elastic member is compressed and generates a deformation force, so as to provide, to the button, the elastic force toward the opening of the accommodating hole.

With reference to the second possible implementation, in a third possible implementation, a blind hole is provided on an end face of the button close to the limiting portion, and the compression spring is inserted into the blind hole. By means of the blind hole, positioning between the elastic member and the button can be achieved.

With reference to the third possible implementation, in a fourth possible implementation, the blind hole and the compression spring are both located on a principal axis of the button, so that the elastic member can exert a relatively even force on the button.

With reference to the first possible implementation, in a fifth possible implementation, the elastic member is a rotary spring, one supporting arm of the rotary spring is connected to the connection lug, and the other supporting arm of the rotary spring is connected to the button. During sliding, the button can drive the other supporting arm of the rotary spring to move, so that the rotary spring generates an elastic force, to cause the button to return to a position before being pressed.

With reference to the fifth possible implementation, in a sixth possible implementation, a mounting groove is provided on the connection lug, an opening of the mounting groove faces the bottom cover, a middle ring-shaped part of the rotary spring is assembled in the mounting groove through the opening of the mounting groove, and the limiting portion blocks the opening of the mounting groove. This facilitates assembly of the rotary spring and the connection lug. The rotary spring can also be positioned when the bottom cover is mounted, providing convenient and rapid assembly.

With reference to any one of the foregoing possible implementations, in a seventh possible implementation, a protrusion is disposed on the end face of the button close to the limiting portion; and when the button moves toward inside of the accommodating hole, the protrusion moves into the through hole, and presses against the telescopic head. A force is exerted on the telescopic head of the spring bar by means of the protrusion, to cause the telescopic head to contract.

With reference to any one of the foregoing possible implementations, in an eighth possible implementation, a guiding bevel is provided on each connection lug, the guiding bevel has a first end and a second end that are opposite to each other, and between the guiding bevels of the two connection lugs, a spacing between the two first ends is greater than a spacing between the two second ends; and the second end extends to the through hole. The two telescopic heads can gradually move along the guiding bevels and gradually contract, making it convenient to insert the two telescopic heads into the through holes of the connection lugs.

With reference to the eighth possible implementation, in a ninth possible implementation, a guiding groove is provided on each connection lug, and a groove bottom surface of the guiding groove forms the guiding bevel. By means of the guiding groove, the telescopic lug can be accurately moved into the through hole, providing convenient assembly.

With reference to any one of the foregoing possible implementations, in a tenth possible implementation, the limiting portions and the bottom cover are integrally formed. The limiting portions and the bottom cover form one component, providing convenient assembly.

According to another aspect, the present invention provides a wearable device, including a wristband and the foregoing main body of a wearable device, where a spring bar is disposed on the wristband, telescopic heads are disposed at two ends of the spring bar, and the telescopic heads at the two ends are respectively inserted into the through holes of the two connection lugs of the main body. When the buttons on the main body are pressed, the telescopic heads can be caused to contract, so that the spring bar can be removed from the two telescopic heads, thereby detaching the wristband from the main body.

In a first possible implementation, when the button moves toward inside of the accommodating hole by a maximum distance, the telescopic heads of the spring bar move completely out of the through holes. Therefore, the spring bar can be removed from the two connection lugs without needing to further exert a force on the wristband.

In a second possible implementation, when the button moves toward inside of the accommodating hole by a maximum distance, an end of the telescopic head is located in the through hole, a hole wall that is in the through hole and that is corresponding to the end of the telescopic head is a tapered surface, and a diameter of an end of the tapered surface close to the spring bar is relatively large. By means of the tapered surface, the telescopic head can be caused to contract by pulling the spring bar outward, making it convenient to remove the spring bar.

With reference to the second possible implementation, in a third possible implementation, when the button moves toward the inside of the accommodating hole by the maximum distance, the end of the telescopic head that is in the through hole is convex arc-shaped. The telescopic head can contract and completely moves out of the through hole by means of the convex arc-shaped end.

According to the wearable device and the main body of the wearable device provided in the present invention, during assembly, the button may be first assembled in the accommodating hole through the opening of the accommodating hole, the limiting groove of the button is aligned with the locating groove, and the bottom cover is assembled onto the main case. In this way, the limiting portion can be inserted into the locating groove and the limiting groove, so that the button is limited in the accommodating hole. Therefore, the wearable device has a simple structure, and is convenient and rapid to assemble. When the two buttons are pressed at the same time, the two telescopic heads of the spring bar are caused to contract, so that the spring bar can be removed from the two connection lugs, thereby detaching the wristband from the main body. Therefore, it is convenient to use.

BRIEF DESCRIPTION OF DRAWINGS

To describe the technical solutions in the embodiments of the present invention or in the prior art more clearly, the following briefly describes the accompanying drawings required for describing the embodiments or the prior art. Apparently, the accompanying drawings in the following description show merely some embodiments of the present invention, and a person of ordinary skill in the art may still derive other drawings from these accompanying drawings without creative efforts.

DESCRIPTION OF EMBODIMENTS

The following clearly and completely describes the technical solutions in the embodiments of the present invention with reference to the accompanying drawings in the embodiments of the present invention.

Referring to FIG. 1 to FIG. 4, FIG. 1 to FIG. 4 show a wearable device according to a first embodiment of the present invention. The wearable device may be a device that can be worn on a wrist, an ankle, or another part, such as a watch, a smartwatch, a smart band, or a smart wristband. In this embodiment, the wearable device is a watch. The wearable device includes a main body 100 and a wristband 200. The main body 100 includes a main case 1 and a bottom cover 2 that are fixedly connected to each other. The main body 100 may be a body of the watch. The main case 1 is an upper case of the body. The bottom cover 2 is a bottom cover 2 of the body.

Figure 1:
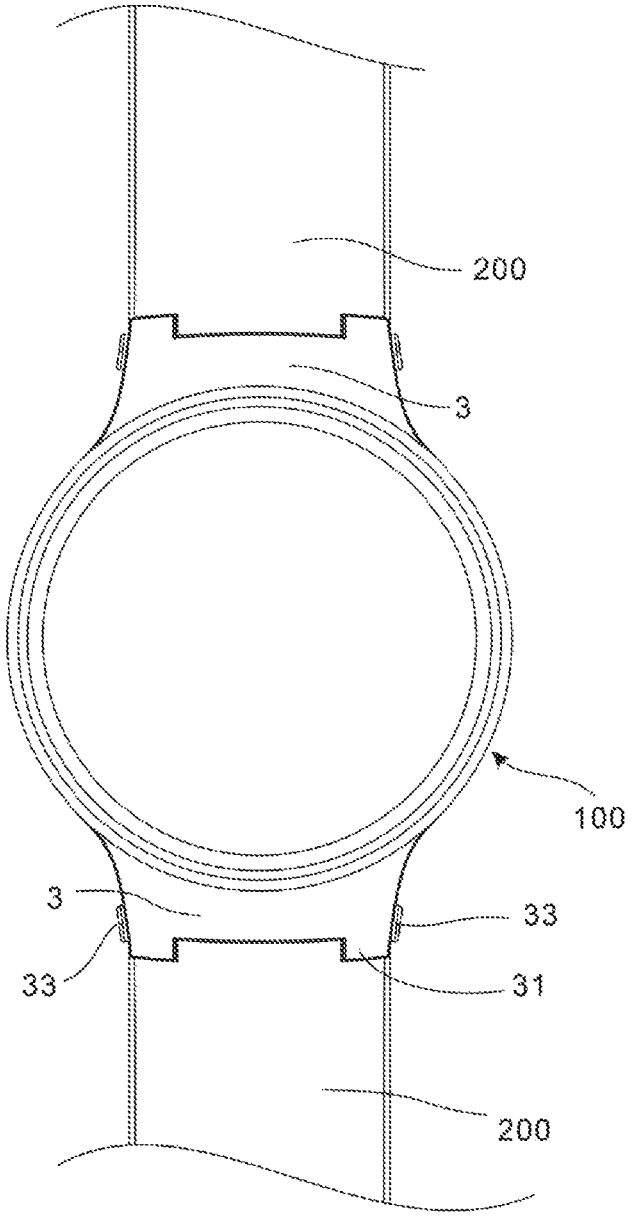
FIG. 1 is a schematic structural diagram of a wearable device according to a first embodiment of the present invention.
Figure 2:
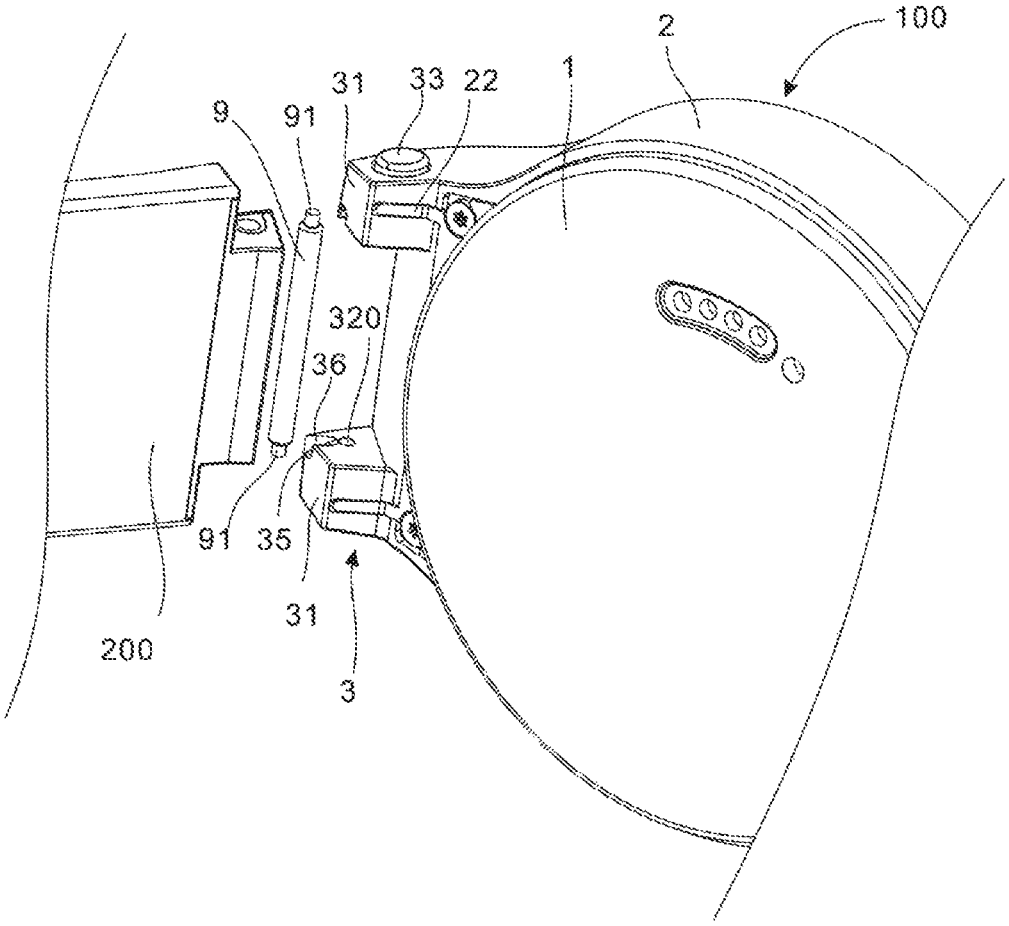
FIG. 2 is a schematic structural diagram of the wearable device in FIG. 1 after a main body is detached from a wristband.

As shown in FIG. 1 and FIG. 2, a connection member 3 is disposed on the main case 1, and is configured to connect to a spring bar 9 on the wristband 200. By means of cooperation between the connection member 3 and the spring bar 9, the main body 100 can be connected to or detached from the wristband 200. The wristband 200 usually includes two parts. The two parts are respectively connected to two ends of the main body 100. Correspondingly, two connection members 3 are disposed on the main case 1, and a spring bar 9 is disposed on each of the two parts of the wristband 200.

Each connection member 3 has two connection lugs 31, and a connection cavity is formed between the two connection lugs 31. The spring bars 9 are disposed on the wristband 200, and the spring bar 9 can be connected to the connection cavity. The spring bar 9 may be the same as a spring bar in the prior art. A telescopic head 91 is disposed at each end of the spring bar 9. The two telescopic heads 91 are respectively inserted to the two connection lugs 31. By means of stretching and contraction of the telescopic head 91, the spring bar 9 can be connected to or detached from the connection lugs 31. Because the spring bar in the prior art can be used as the spring bar 9, the connection member 3 can be correspondingly connected to a wristband in the prior art directly without needing to perform special processing on a structure of the wristband, thereby making it convenient for a user to change the wristband.

An accommodating hole 30 is provided on each connection lug 31. One end of the accommodating hole 30 has an opening, and the other end of the accommodating hole 30 is provided with a connection portion 32. The connection portion 32 is closer to the other connection lug 31 than the opening of the accommodating hole 30. The connection portion 32 is provided with a through hole 320 in communication with the accommodating hole 30. A button 33 is disposed on each connection lug 31. The button 33 is slidably disposed in the accommodating hole 30. By means of the accommodating hole 30, the button 33 can be conveniently disposed, and sliding of the button 33 is facilitated. The connection portion 32 limits a maximum distance by which the button 33 can slide into the accommodating hole 30. By means of the opening of the accommodating hole 30, the button 33 can be disposed in the accommodating hole 30 through the opening. This facilitates assembly. The through hole 320 may correspondingly match the telescopic head 91 of the spring bar 9, to facilitate insertion of the telescopic head 91.

Figure 3:
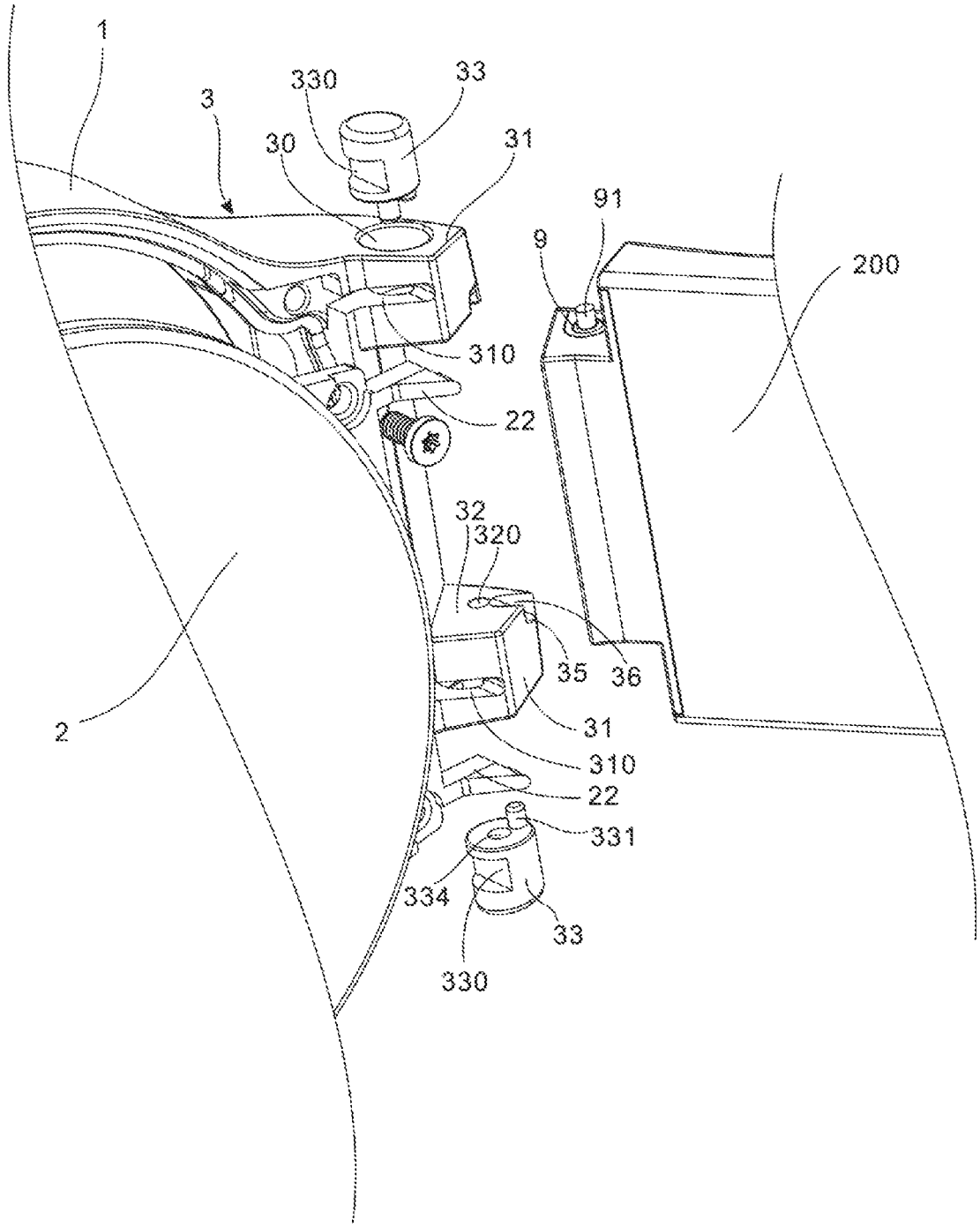
FIG. 3 is a schematic exploded view of the wearable device in FIG. 1.
Figure 4:
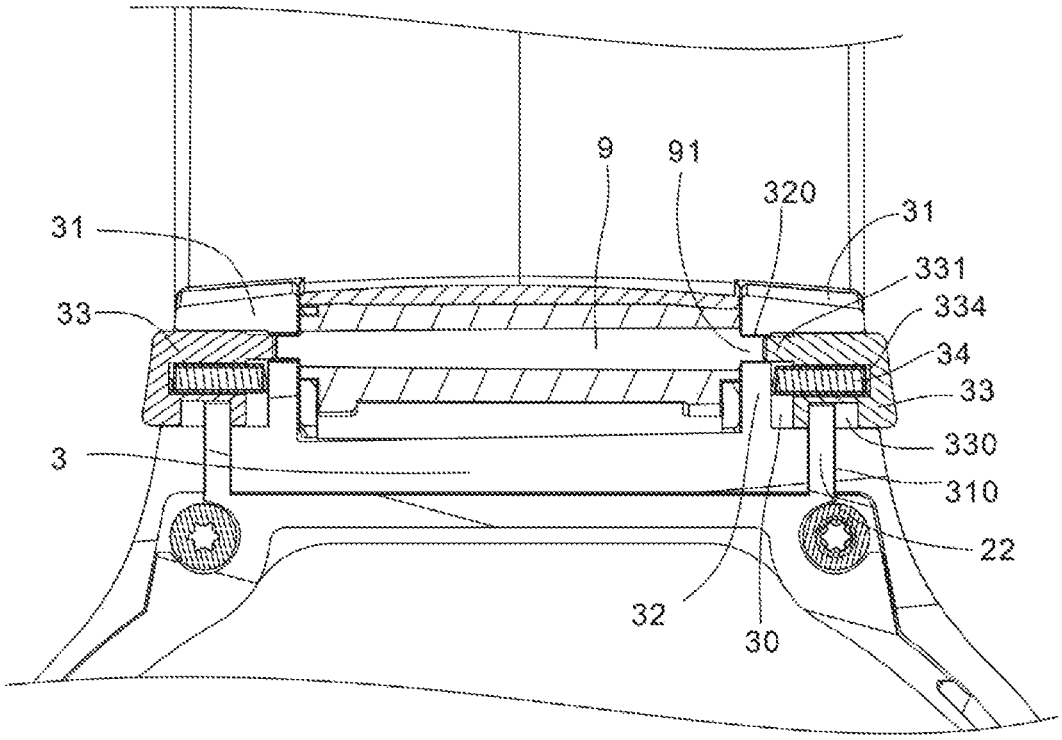
FIG. 4 is a cross-sectional view of the wearable device in FIG. 1 at an axial position of a spring bar.

As shown in FIG. 3 and FIG. 4, a locating groove 310 is provided on a surface of the connection lug 31 facing the bottom cover 2. The locating groove 310 is in communication with the accommodating hole 30. A limiting groove 330 is provided at a position that is on the button 33 and that is corresponding to the locating groove 310. A limiting portion 22 is disposed on the bottom cover 2. The limiting portion 22 is located in the locating groove 310 and extends into the limiting groove 330. The limiting portion 22 can prevent the button 33 from moving out of the opening of the accommodating hole 30. Because the locating groove 310 is provided on the surface of the connection lug 31 facing the bottom cover 2, the limiting portion 22 may enter the locating groove 310 and the limiting groove 330 in sequence when the bottom cover 2 is connected to the main case 1 during assembly, and after assembly, the limiting portion 22 is located in the limiting groove 330, and therefore can limit a sliding range of the button 33, thereby preventing the button 33 from moving out of the accommodating hole 30.

When the main body 100 is connected to the wristband 200, the telescopic head 91 is in a stretching state and is inserted into the through hole 320, and the button 33 moves toward the opening of the accommodating hole 30 by the maximum distance. In this case, the button 33 protrudes out of the opening of the accommodating hole 30, making it convenient for the user to press the button 33 inward. When the wristband 200 needs to be detached from the main body 100, the user may press the buttons 33 on the two connection lugs 31 at the same time. When pressed, the two buttons 33 move toward each other, and move toward inside of the accommodating hole 30. When moving toward the inside of the accommodating hole 30, the buttons 33 press against the telescopic heads 91, so that the telescopic heads 91 contract. The telescopic heads 91 can move out of the through holes 320. In this way, the wristband 200 is detached from the main body 100, providing convenient and rapid use.

According to the wearable device provided in the present invention, during assembly, the button 33 may be first disposed in the accommodating hole 30 through the opening of the accommodating hole 30, the limiting groove 330 of the button 33 is aligned with the locating groove 310, and the bottom cover 2 is assembled onto the main case 1. In this way, the limiting portion 22 can be inserted into the locating groove 310 and the limiting groove 330, so that the button 33 is limited in the accommodating hole 30. Therefore, the wearable device has a simple structure, and is convenient and rapid to assemble. When the two buttons 33 are pressed at the same time, the two telescopic heads 91 of the spring bar 9 are caused to contract, so that the spring bar 9 can be removed from the two connection lugs 31, thereby detaching the wristband 200 from the main body 100. Therefore, it is convenient to use.

Preferably, the accommodating hole 30 is a circular hole, and the button 33 is correspondingly cylinder-shaped. Certainly, in another implementation, the accommodating hole 30 may alternatively be a rectangular hole, and the button 33 is correspondingly cuboid-shaped. Alternatively, the accommodating hole 30 is a triangular hole, and the button 33 is correspondingly triangular prism-shaped.

In this embodiment, an elastic member 34 is disposed in the accommodating hole 30, the elastic member 34 is connected to the button 33, and the elastic member 34 is capable of providing, to the button 33, an elastic force toward the opening of the accommodating hole 30. By means of the elastic member 34, the button 33 can automatically return to a state before being pressed. Therefore, it is convenient to use.

Preferably, the elastic member 34 may be a compression spring, and two ends of the compression spring respectively press against the button 33 and the connection portion 32. When the button 33 moves toward the connection portion 32, the elastic member 34 is compressed and generates a deformation force, so as to provide, to the button 33, the elastic force toward the opening of the accommodating hole 30, so that the button 33 can automatically return to an original state after being pressed.

Further, a blind hole 334 is provided on an end face of the button 33 close to the connection portion 32. The elastic member 34 is inserted into the blind hole 334. By means of the blind hole 334, positioning between the elastic member 34 and the button 33 can be achieved, so as to prevent the elastic member 34 and the button 33 from moving relative to each other during compression to affect the elastic force on the button 33. The blind hole 334 and the compression spring 34 are both located on a principal axis of the button 33, so that the elastic member 34 can exert a relatively even force on the button 33.

A protrusion 331 is disposed on the end face of the button 33 close to the connection portion 32. When the button 33 moves toward the accommodating hole 30, the protrusion 331 moves into the through hole 320, and presses against the telescopic head 91. When the button 33 is pressed, the protrusion 331 may move into the through hole 320. A force is exerted on the telescopic head 91 of the spring bar 9 by means of the protrusion 331, to cause the telescopic head 91 to contract, so that the telescopic head 91 moves out of the through hole 320 completely, making it convenient to remove the spring bar 9 from the two connection lugs 31. The protrusion 331 is located at an eccentric position on the button 33, so that the protrusion 331 and the elastic member 34 are staggered relative to each other, to facilitate connection during assembly.

In this embodiment, a guiding bevel 35 is disposed on each connection lug 31. The guiding bevel 35 has a first end and a second end that are opposite to each other. Between the guiding bevels 35 of the two connection lugs 31, a spacing between the two first ends is greater than a spacing between the two second ends. The first end is located at an edge of the connection lug 31, and the second end extends to the through hole 320. When the spring bar 9 is connected to the two connection lugs 31, the telescopic heads 91 at the two ends of the spring bar 9 respectively press against the first ends of the two guiding bevels 35. When the spring bar 9 is moved toward the through holes 320, the two telescopic heads 91 can gradually move along the guiding bevels 35 and gradually contract, making it convenient to insert the two telescopic heads 91 into the through holes 320 of the connection lugs 31.

More specifically, a guiding groove 36 is provided on each connection lug 31. A groove bottom surface of the guiding groove 36 forms the guiding bevel 35. By means of the guiding groove 36, the telescopic lug can be accurately moved into the through hole 320, providing convenient assembly. Herein, in another implementation, the guiding groove 36 may not be provided. An outer surface of the connection lug 31 may be used to directly form the guiding bevel 35.

Because there are two connection members 3, there are four connection lugs 31 correspondingly, and there are four corresponding limiting portions 22, to respectively limit the four buttons 33. In this embodiment, the limiting portions 22 and the bottom cover are integrally formed. The four limiting portions 22 and the bottom cover form one component. When the bottom cover is mounted on the main case 1 by using a screw, the limiting portions 22 are positioned in the connection lugs 31 and cannot move, providing convenient assembly. When the bottom cover is mounted, mounting of the limiting portions 22 is also implemented, so as to limit the buttons 33. This facilitates mounting and removal and can reduce a quantity of parts, facilitating processing and production. Herein, in another implementation, the limiting portions 22 and the bottom cover 2 may form a separable structure. The four limiting portions 22 are independent components, and may be mounted respectively on the four connection lugs 31. An edge of the bottom cover 2 presses against the locating grooves 310, to fasten the limiting portions 22 to the connection lugs 31. During assembly, the limiting portions 22 may be first disposed in the locating grooves 310, followed by mounting of the bottom cover 2. In this way, the assembly is completed, and the limiting portions 22 do not need to be separately fastened by using a fastener such as a screw, providing convenient assembly. In the foregoing implementation, the limiting portion 22 and the bottom cover 2 may be made of a same material, for example, a metal. In still another implementation, a seal ring is disposed on the bottom cover 2. The seal ring is located between the bottom cover 2 and the main case 1, and is used for sealing between the bottom cover 2 and the main case 1. The limiting portions 22 and the seal ring form a one-piece structure. After the seal ring is mounted on the bottom cover 2, the limiting portions 22 can also be mounted on the bottom cover 2. After the bottom cover 2 is fastened to the main case 1 by using a screw, the limiting portion 22 can also be fastened to connection lugs 31. The limiting portion 22 and the seal ring may be made of a rubber material, so that sealing can be achieved at the locating groove 310.

Figure 5:
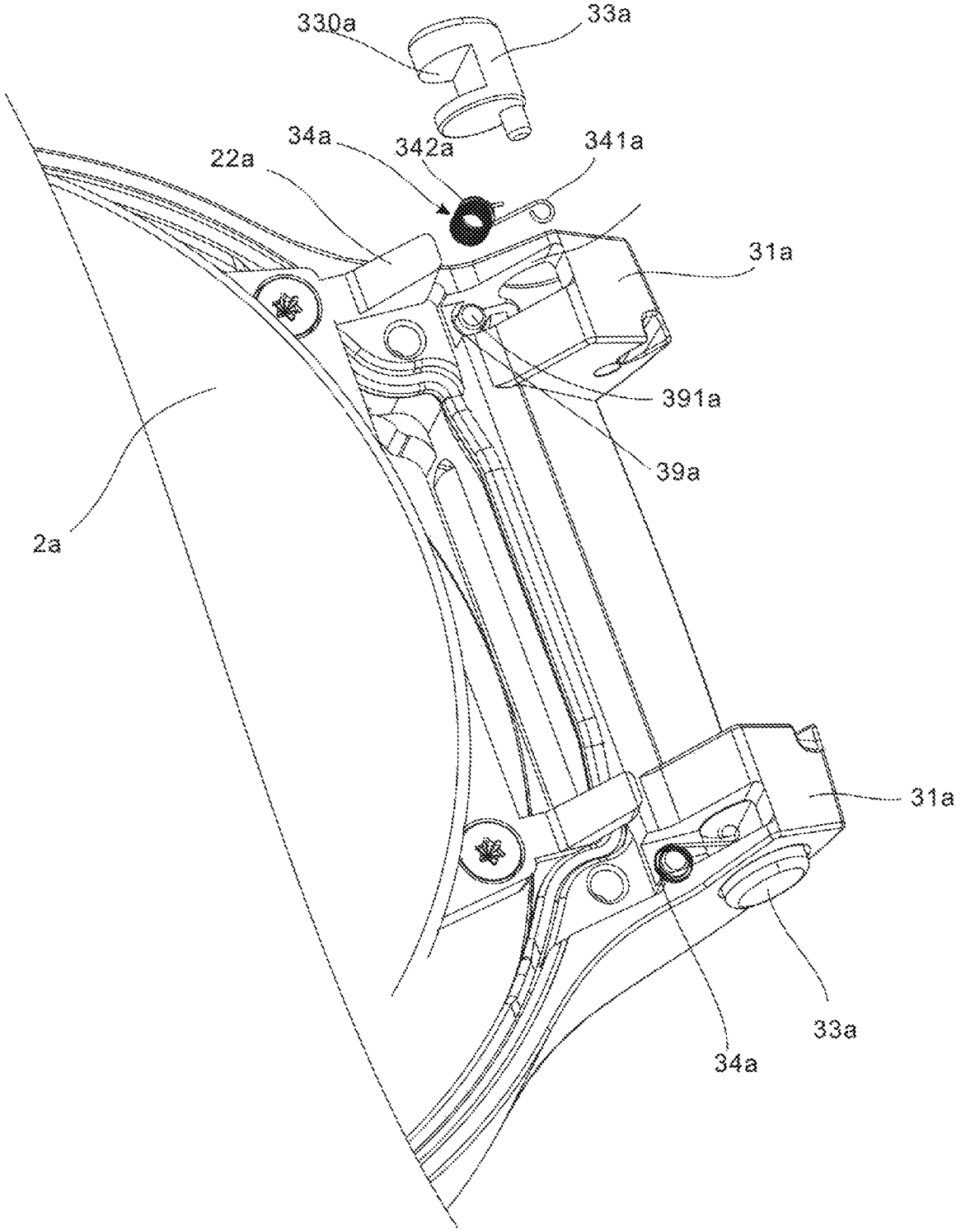
FIG. 5 is a schematic structural diagram of a main body of a wearable device according to a second embodiment of the present invention.

As shown in FIG. 5, in a second embodiment of a wearable device provided in the present invention, structures of components such as a main case 1*a*, a bottom cover 2*a*, and buttons 32*a* are generally the same as those in the first embodiment. Herein, only differences are described in detail, and other parts are not described herein again.

In this embodiment, as shown in FIG. 5, the elastic member is a rotary spring 34*a*. The rotary spring 34*a* is mounted on a connection lug 31*a*. One supporting arm of the rotary spring is connected to the connection lug 31*a*, and the other supporting arm 341*a* of the rotary spring is connected to the button 33*a*. During sliding, the button 33*a* can drive the other supporting arm 341*a* of the rotary spring to move, so that the rotary spring 34*a* generates an elastic force, to cause the button 33*a* to return to a position before being pressed. The other supporting arm 341*a* of the rotary spring 34*a* may extend into the limiting groove 330*a*. The rotary spring is connected to the button 33*a* by means of the limiting groove 330*a*, providing convenient assembly.

More specifically, a mounting groove 39*a* is provided on the connection lug 31*a*. An opening of the mounting groove 39*a* faces the bottom cover 2*a*. A middle ring-shaped part 342*a* of the rotary spring 34*a* is assembled in the mounting groove 39*a* through the opening of the mounting groove 39*a*. A limiting portion 22*a* blocks the opening of the mounting groove 39*a* to limit the rotary spring 34*a* in the mounting groove 39*a*. This facilitates assembly of the rotary spring 34*a* and the connection lug 31*a*. The rotary spring 34*a* can also be positioned when the bottom cover 2*a* is mounted, providing convenient and rapid assembly. Further, a mounting column 391*a* is further disposed in the mounting groove 39*a*. The middle ring-shaped part 342*a* of the rotary spring 34*a* is sleeved on the mounting column 391*a*, to further facilitate positioning and mounting of the rotary spring 34*a*.

Herein, in another embodiment, the elastic member may alternatively be an elastic component in another structural form, such as an elastic plate or an elastic silicone pad, provided that the elastic component is capable of providing a force to the button to cause the button to move toward the opening of the accommodating hole.

Figure 6:
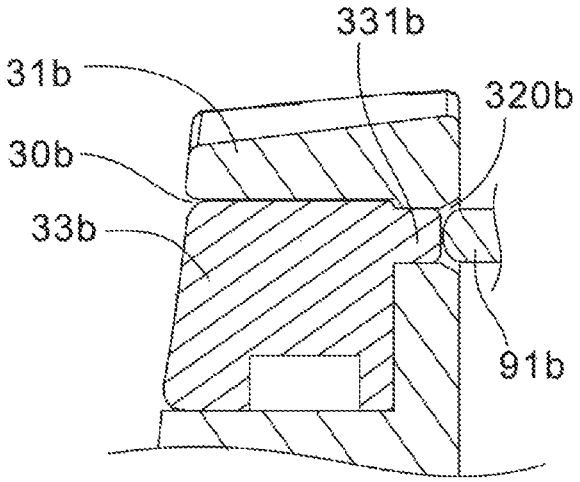
FIG. 6 is a partial schematic structural diagram of a wearable device at a position at which a button is fitted to a spring bar according to a third embodiment.

In the foregoing embodiment, when the button moves toward the inside of the accommodating hole by the maximum distance, the telescopic head of the spring bar can completely move out of the through hole. Therefore, the spring bar can be removed from the two connection lugs without needing to further exert a force on the wristband. Herein, in another implementation, as shown in FIG. 6, in a wearable device provided in a third embodiment of the present invention, after a button 33*b* moves toward inside of an accommodating hole 30*b* by a maximum distance, an end of a telescopic head 91*h* is located in a through hole 320*b*, and the telescopic head 91*b* does not completely move out of the through hole 320. A hole wall that is in the through hole 320*b* and that is corresponding to the end of the telescopic head 91*b* is a tapered surface, and a diameter of an end of the tapered surface close to a spring bar 9 is relatively large. By means of the tapered surface, the telescopic head 91*b* can be caused to contract by pulling the spring bar outward, making it convenient to remove the spring bar. Further, when the button moves toward the inside of the accommodating hole by the maximum distance, the end of the telescopic head 91*b* that is in the through hole 320*b* is convex arc-shaped. During detaching, the button 33*b* is pressed, and after a three is exerted on the spring bar, the telescopic head 91*b* can contract and completely move out of the through hole 320*b* by means of the convex arc-shaped end, so that the spring bar is removed. Further, after the button 33*b* moves toward the inside of the accommodating hole 30*b* by the maximum distance, because the telescopic head 91*b* does not completely move out of the through hole 320*b* after the button 33*b* is completely pressed, the spring bar does not fall off automatically, thereby preventing the wristband from suddenly falling off upon pressing of the button 33*b*.

The foregoing implementations are not intended to limit the protection scope of the technical solutions. Any modification, equivalent replacement, and improvement made without departing from the spirit and principle of the foregoing implementations shall fall within the protection scope of the technical solutions.

The invention claimed is:

1. A main body of a wearable device, comprising:

a bottom cover comprising a limiting portion; and a main case coupled to the bottom cover, wherein a connection member configured to couple to a spring bar is disposed on the main case, wherein the connection member has two connection lugs, wherein an accommodating hole is provided on each connection lug, wherein a first end of the accommodating hole has an opening, wherein a second end of the accommodating hole is provided with a connection portion, wherein the connection portion is proximate to the other connection lug than the opening of the accommodating hole, wherein the connection portion is provided with a through hole coupled with the accommodating hole, wherein a locating groove is provided on a surface of a connection lug facing the bottom cover, wherein the locating groove is coupled with the accommodating hole, wherein a button is disposed on each connection lug, wherein the button is slidably disposed in the accommodating hole, and wherein a limiting groove is provided at a position on the button corresponding to the locating groove, wherein the limiting portion is located in the locating groove and extends into the limiting groove, and wherein the limiting portion is configured to prevent the button from moving out of the opening of the accommodating hole.

2. The main body of claim 1, wherein an elastic member is disposed in the accommodating hole and coupled to the button, and wherein the elastic member is configured to provide, to the button, an elastic force toward the opening of the accommodating hole.

3. The main body of claim 2, wherein the elastic member is a compression spring, and wherein two ends of the compression spring respectively press against the button and the connection portion.

4. The main body of claim 3, wherein a blind hole is provided on an end face of the button proximate to the connection portion, and wherein the compression spring is inserted into the blind hole.

5. The main body of claim 4, wherein the blind hole and the compression spring are located on a principal axis of the button.

6. The main body of claim 2, wherein the elastic member is a rotary spring, wherein a first supporting arm of the rotary spring is coupled to the connection lug, and wherein a second supporting arm of the rotary spring is coupled to the button.

7. The main body of claim 6, wherein a mounting groove is provided on the connection lug, wherein an opening of the mounting groove is configured to face the bottom cover, wherein a middle ring-shaped part of the rotary spring is assembled in the mounting groove through the opening of the mounting groove, and wherein the limiting portion is configured to block the opening of the mounting groove.

8. The main body of claim 1, wherein a protrusion is disposed on an end face of the button proximate to the connection portion, and wherein the protrusion is configured to move into the through hole and press against a telescopic head when the button moves toward inside of the accommodating hole.

9. The main body of claim 1, wherein a guiding bevel is provided on each connection lug, wherein the guiding bevel has a first end and a second end opposite to each other, wherein the second end is configured to extend to the through hole, and wherein between the guiding bevels of the two connection lugs, a spacing between two first ends is greater than a spacing between two second ends.

10. The main body of claim 9, wherein a guiding groove is provided on each connection lug, and wherein a groove bottom surface of the guiding groove is configured to form the guiding bevel.

11. The main body of claim 10, wherein the limiting portion and the bottom cover are integrally formed.

12. A wearable device, comprising:

a main body; and a wristband coupled to the main body, wherein a spring bar is disposed on the wristband, wherein telescopic heads are disposed at two ends of the string bar, and wherein the telescopic heads are respectively inserted into through holes of two connection lugs of the main body, and wherein the main body comprises:

a bottom cover comprising a limiting portion; and a main case coupled to the bottom cover, wherein a connection member disposed on the main case is configured to couple to the spring bar, wherein the connection member has the two connection lugs, wherein an accommodating hole is provided on each connection lug, wherein a first end of the accommodating hole has an opening, wherein a second end of the accommodating hole is provided with a connection portion, wherein the connection portion is proximate to the other connection lug than the opening of the accommodating hole, wherein the connection portion is provided with a through hole coupled with the accommodating hole, wherein a locating groove is provided on a surface of a connection lug facing the bottom cover, wherein the locating groove is coupled with the accommodating hole, wherein a button is disposed on each connection lug, wherein the button is slidably disposed in the accommodating hole, wherein a limiting groove is provided at a position on the button corresponding to the locating groove, wherein the limiting portion is disposed on the bottom cover, wherein the limiting portion is located in the locating groove and extends into the limiting groove, and wherein the limiting portion is configured to prevent the button from moving out of the opening of the accommodating hole.

13. The wearable device of claim 12, wherein the telescopic heads of the spring bar are configured to completely move out of through holes when the button moves toward inside of the accommodating hole by a maximum distance.

14. The wearable device of claim 12, wherein an end of of a telescopic head is located in the through hole when the button moves toward inside of the accommodating hole by a maximum distance, wherein a hole wall in the through hole corresponding to the end of the telescopic head is a tapered surface, and wherein a diameter of an end of the tapered surface proximate to the spring bar is relatively large.

15. The wearable device of claim 14, wherein the end of the telescopic head in the through hole is convex arc-shaped when the button moves toward the inside of the accommodating hole by the maximum distance.

16. The wearable device of claim 12, wherein an elastic member is disposed in the accommodating hole and coupled to the button, and wherein the elastic member is configured to provide, to the button, an elastic force toward the opening of the accommodating hole.

17. The wearable device of claim 16, wherein the elastic member is a compression spring, and wherein two ends of the compression spring respectively press against the button and the connection portion.

18. The wearable device of claim 17, wherein a blind hole is provided on an end face of the button proximate to the connection portion, and wherein the compression spring is inserted into the blind hole.

19. The wearable device of claim 18, wherein the blind hole and the compression spring are located on a principal axis of the button.

20. The wearable device of claim 16, wherein the elastic member is a rotary spring, wherein a first supporting arm of the rotary spring is coupled to the connection lug, and wherein a second supporting arm of the rotary spring is coupled to the button.

* * * * *